US007857798B2

(12) United States Patent
Buettner

(10) Patent No.: US 7,857,798 B2
(45) Date of Patent: Dec. 28, 2010

(54) STRAPLESS G-STRING OR THONG

(75) Inventor: Jenny Buettner, Huntington Beach, CA (US)

(73) Assignee: Tabue Technology, LP, Huntington Beach, CA (US)

( * ) Notice: Subject to any disclaimer, the term of this patent is extended or adjusted under 35 U.S.C. 154(b) by 907 days.

(21) Appl. No.: 11/635,103

(22) Filed: Dec. 6, 2006

(65) Prior Publication Data

US 2007/0124850 A1 Jun. 7, 2007

Related U.S. Application Data

(60) Provisional application No. 60/742,866, filed on Dec. 6, 2005.

(51) Int. Cl.
*A61F 13/15* (2006.01)

(52) U.S. Cl. ..... 604/385.01; 604/361; 604/367; 604/374

(58) Field of Classification Search ..... 604/385.01, 604/361, 367, 374
See application file for complete search history.

(56) References Cited

U.S. PATENT DOCUMENTS 5,103,816 A * 4/1992 Kirschbaum et al. ... 128/207.14
5,467,482 A 11/1995 Crawford, II
5,832,535 A 11/1998 Davis
6,595,977 B1 * 7/2003 Luizzi et al. ..... 604/390
6,681,407 B2 1/2004 Martz
6,738,988 B2 5/2004 Ruiter et al.
6,758,720 B2 7/2004 Chen
6,780,081 B2 8/2004 Chen et al.
2004/0064872 A1 4/2004 Ruiter et al.
2004/0097899 A1 5/2004 Bethea
2004/0102747 A1 5/2004 Bell et al.
2004/0224607 A1 11/2004 Chen et al.

FOREIGN PATENT DOCUMENTS

KR 290-1986-000118 U 2/1986
KR 20-0224705 Y1 3/2001

OTHER PUBLICATIONS

International Search Report dated Jul. 9, 2008.

* cited by examiner

*Primary Examiner*—Jacqueline F. Stephens
(74) *Attorney, Agent, or Firm*—Knobbe Martens Olson & Bear, LLP

(57) ABSTRACT

A strapless G-string or thong type undergarment is disclosed. The undergarment is adhered to the wearer by means of adhesive, thereby eliminating the need for a waistband. The undergarment provides freedom of movement and confidence in the wearer while being invisible under closely fitting or low-cut clothing.

9 Claims, 5 Drawing Sheets

STRAPLESS G-STRING OR THONG

RELATED APPLICATIONS

This application claims priority to U.S. Provisional Application No. 60/742,866, filed Dec. 6, 2005, which is incorporated herein by reference.

BACKGROUND OF THE INVENTION

1. Field of the Invention

This invention relates generally to the field of brief-type garments for men and women, and more particularly to an open-sided, waistless G-string or thong-type garment which is undetectable under form-fitting clothing.

2. Description of the Related Art

A problem encountered when wearing tight, form-fitting clothing is that the wearer's undergarments tend to show through creating distracting lines in the clothing. This is a problem even when the undergarment is minimal such as a thong or G-string, because the waistband is visible through certain types of clothing including clingy and/or form-fitting garments. Also, when wearing low-cut clothing such as low-riding pants, the waist band of the underwear is easily visible. In tight dresses or slinky evening gowns a regular G-string or thong can be seen with unattractive cut marks across the hips.

U.S. Pat. No. 5,832,535 discloses a strapless genital covering garment for use when tanning or during certain types of surgical procedures. However, this garment is not intended to stay securely in place during everyday movement.

U.S. Pat. No. 6,738,988 discloses a waistless thong type garment. This waistless garment is maintained in place by a spring wire frame.

Embodiments of the invention are directed to a thong or G-string type undergarment which is kept in place by means of adhesive, without the need for a waistband. Panty lines are eliminated altogether while providing coverage, security and comfort for the wearer. The coverage and comfort provided by the undergarment confer a feeling of freedom and confidence to the wearer.

SUMMARY OF THE INVENTION

Embodiments of the invention are directed to an open-sided brief garment, which includes an anterior portion configured to cover the genital region of a wearer and having an interior surface along a top region and a posterior portion attached to the anterior portion by a material strip or string and having an interior surface along a distal region. Preferably, the anterior portion and the posterior portion attach to the wearer by a removable pressure sensitive adhesive affixed to interior surfaces of the anterior and the posterior portions of the garment, whereby the garment does not readily shift after positioning the adhesive portions on the wearer.

Preferably, the anterior portion of the open-sided brief garment is generally triangular. In some preferred embodiments, the garment is a thong style. In alternate preferred embodiments, the garment is a G-string style.

In preferred embodiments, the pressure sensitive adhesive layer has an adhesion force to the interior surface of the posterior and anterior portions which is greater than a cohesion force to the wearer's skin.

In some preferred embodiments, the interior surfaces of the anterior and posterior portions also include a reinforcing layer supporting the pressure sensitive adhesive layer between the pressure sensitive adhesive layer and a fabric material. Preferably, the reinforcing layer is selected from a thermoplastic film, an unwoven fabric material, a woven fabric material, a foam material and combinations thereof.

In preferred embodiments, the pressure sensitive adhesive is permanently grown to the interior surfaces of the anterior and posterior portions. In alternate preferred embodiment, the pressure sensitive adhesive is a double-sided tape. Preferably, the double-sided tape is a whiteliner tape, more preferably, 3M #1522.

Preferably, the open-sided brief garment is reusable.

Further aspects, features and advantages of this invention will become apparent from the detailed description of the preferred embodiments which follow.

BRIEF DESCRIPTION OF THE DRAWINGS

These and other feature of this invention will now be described with reference to the drawings of preferred embodiments which are intended to illustrate and not to limit the invention.

DETAILED DESCRIPTION OF THE PREFERRED EMBODIMENT

Embodiments of the invention are directed to an undergarment which is kept in place on the body by means of adhesive.

The undergarment according to embodiments of the invention may be disposable or may be used for repeated wearings.

Embodiments of the invention may include a front body section which is releasably adhered to the abdomen of the wearer and a lower elongated section which extends through the wearer's legs and is provided with a distal end which is releasably attached to the back of the wearer, in an area which is generally above the buttock area. In some embodiments, the distal end may be very thin so that it goes between the buttocks (g-string style). In alternate embodiments, the distal end may have more material and be approximately V-shaped (thong style).

Figure 1:
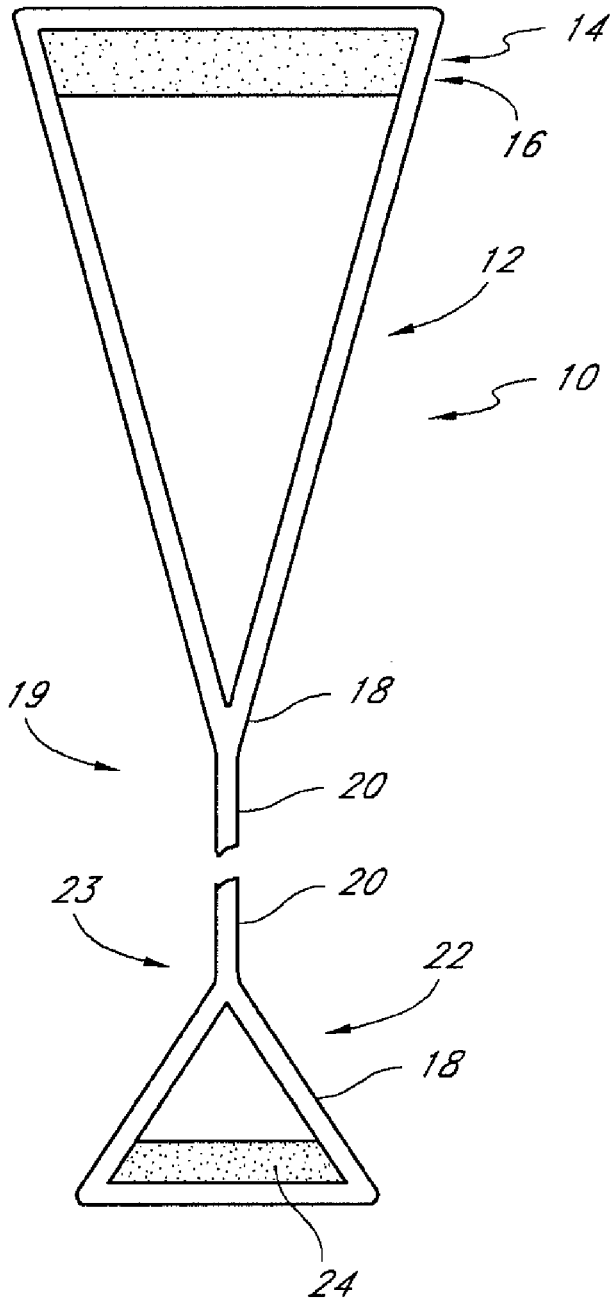
FIG. 1 shows a plan view of one embodiment of the open-sided brief garment of the present invention.

FIG. 1 shows an embodiment of the invention in which a G-string 10 is shown to include a substantially triangular front section 12 having an area at the upper end 14 thereof for the application of an adhesive. Any suitable material may be used to provide adhesion. The adhesive may be applied during production of the garment or by the wearer. In some embodiments, a double-sided adhesive tape is applied to provide adhesion as necessary. An example of a suitable double-sided adhesive tape, usable in embodiments of the invention is 3M 1522 double sided tape, which can be reused for several washings. Upper end 14 is shown to be provided with a first anchoring area for an adhesive 16. In the embodiment shown in FIG. 1, the G-string 10 is edged with a binding material 18. The binding material prevents fraying or unraveling of the material. Any technique that prevents undesirable fraying or unraveling may be used such as hemming the garment around the edges, heat welded seams, use of a seam tape or heat seal tape or a combination. In preferred embodiments, the binding material is a bias binding or piping material which is attached to the g-string by stitching. The binding material binds the circumference of the substantially triangular section 12 and meets at the lower end of the triangular section to form a string 20 which goes between the legs to the lower end portion 22. The binding material 18 continues to bind the outer circumference of the lower end portion 22. In alternate embodiments, the string may be a thin strip of material that is fastened to the bottom of the triangular front section on the proximal end 19 and to the top of the lower end portion 22 at the distal end 23. At the end of the lower end portion 24 there is a second anchoring area for application of adhesive material.

Figure 2:
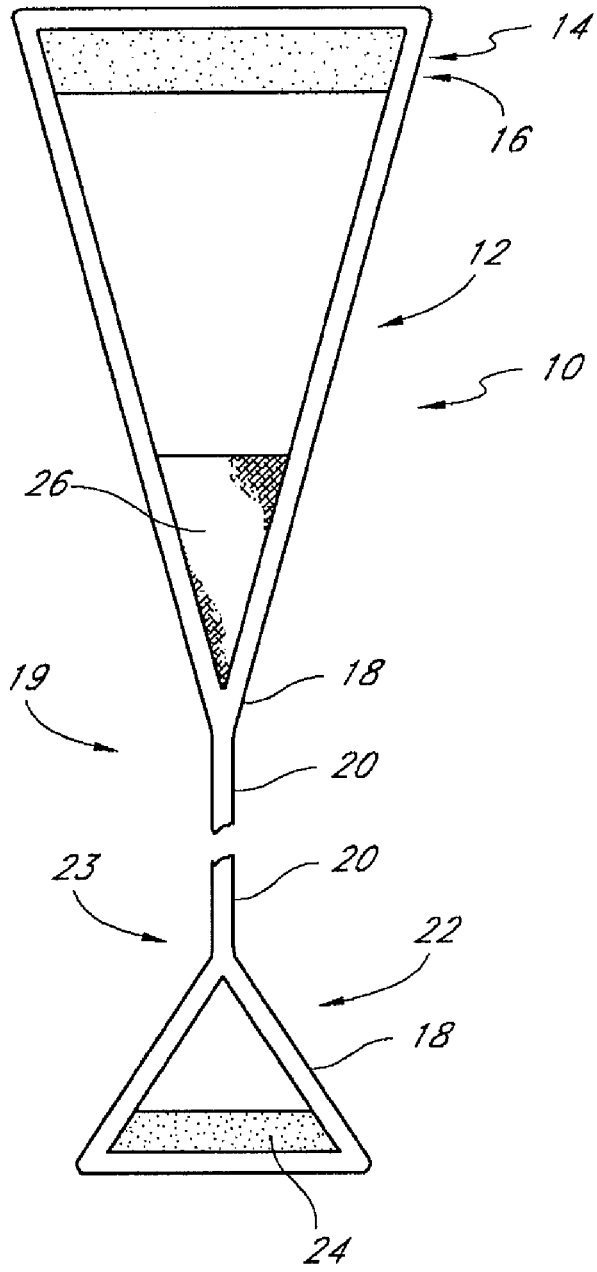
FIG. 2 shows a plan view of one embodiment of the open-sided brief garment of the present invention.

FIG. 2 shows a modification of FIG. 1 in which a second layer of material 26 has been inserted, for example, a cotton liner for added comfort.

Figure 3:
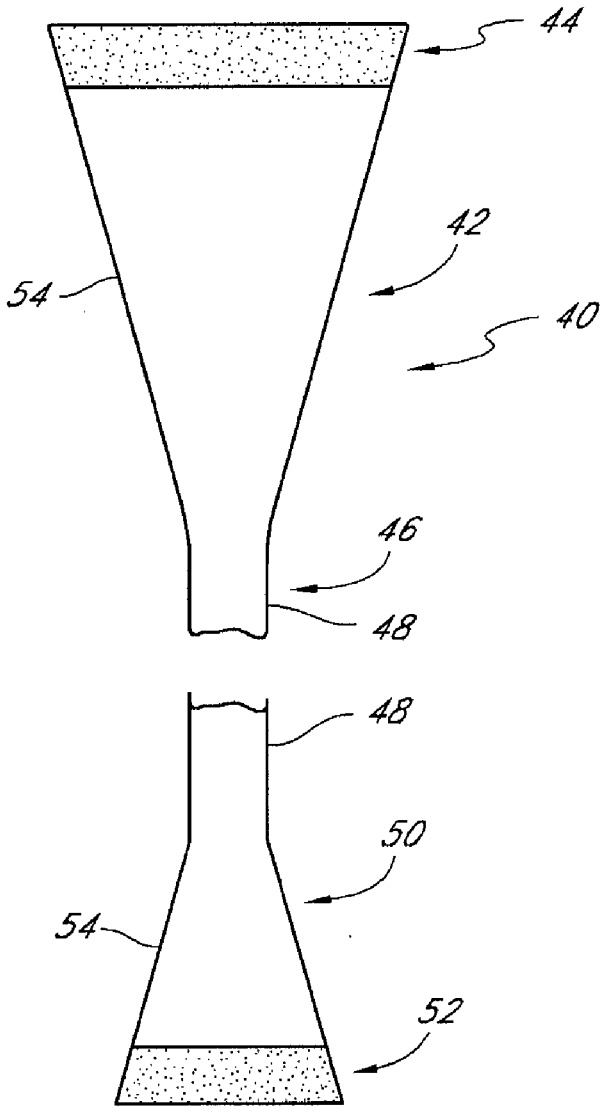
FIG. 3 shows a plan view of one embodiment of the open-sided brief garment of the present invention.

FIG. 3 shows a thong-type embodiment of the invention 40 which includes a substantially triangular front section 42 having a first anchoring area at the upper end 44 for the administration of an adhesive. Any suitable material may be used to provide adhesion. The adhesive may be applied during production of the garment or by the wearer. In some embodiments, a double-sided tape is used to provide adhesion as discussed above. At the lower end 46 of the upper triangular section, there is a middle section 48 that goes between the legs of the wearer to join a lower end section 50 with a second anchoring area 52 for application of the adhesive.

Undesirable fraying or unraveling of the edge of the material 54 may be prevented by well known techniques such as a binding edge or hemming the garment around the edges, heat welded seams, use of a seam tape or heat seal tape or a combination. Note that it is not necessary that the lower end section 50 have straight sides as shown in FIG. 3. The strip area covering the cleft in the buttock of the wearer 48 may be significantly narrower than the upper section 52.

Figure 4:
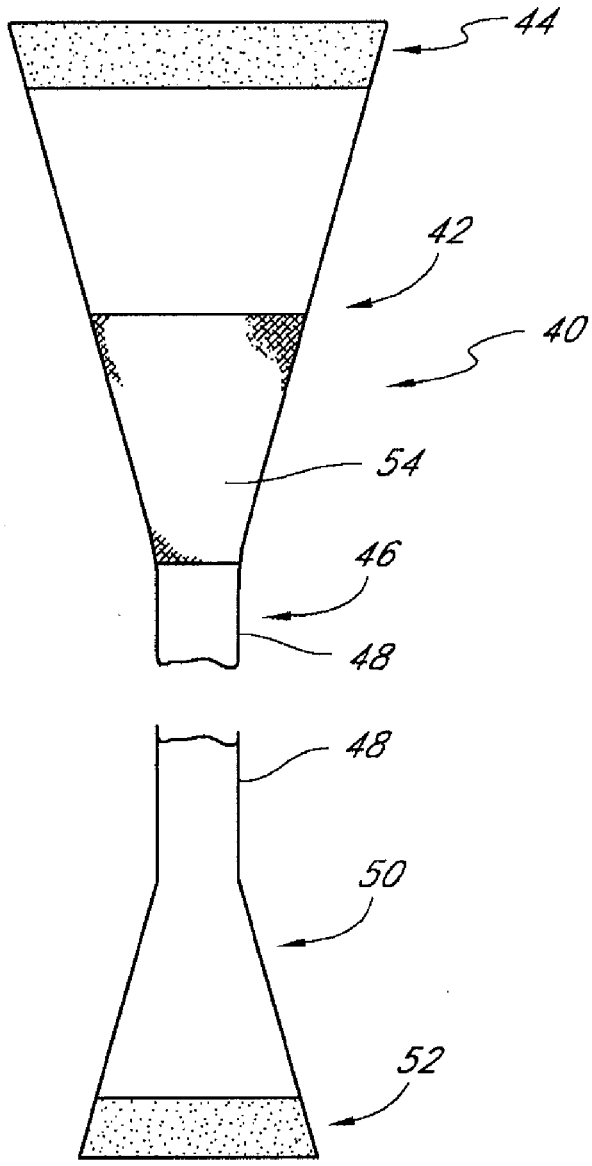
FIG. 4 shows a plan view of one embodiment of the open-sided brief garment of the present invention.

The embodiment of FIG. 4 shows a variation of FIG. 3 in which a second layer of material 54 has been inserted into the thong shown in FIG. 3, for example, a cotton liner for added comfort.

Figure 5:
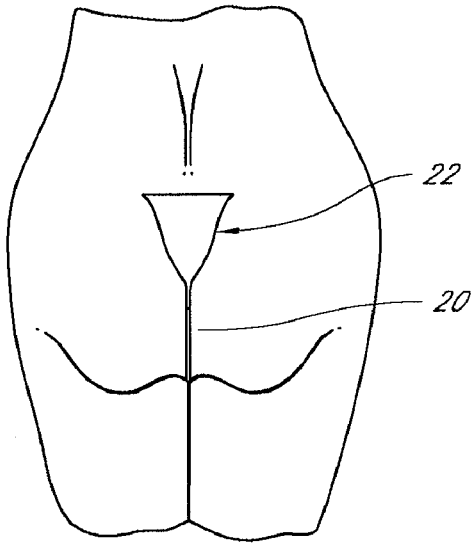
FIG. 5 shows a pictorial view of the rear of a person wearing one embodiment of the open-sided brief garment of the present invention.
Figure 6:
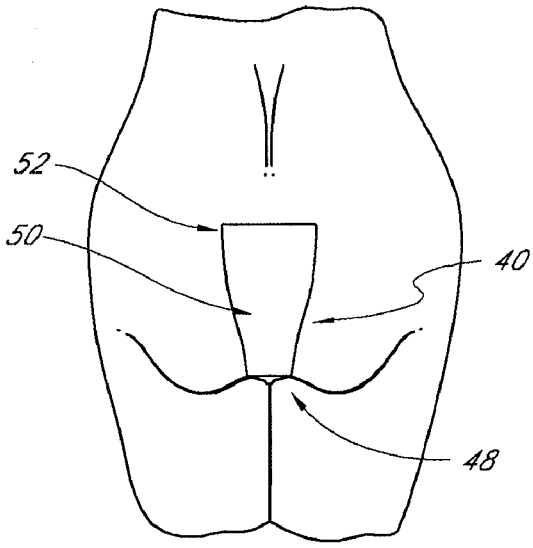
FIG. 6 shows a pictorial view of the rear of a person wearing one embodiment of the open-sided brief garment of the present invention.

FIG. 5 is a pictorial view of the wearer from the rear. As seen in FIG. 6, the lower strip 20 extends from between the wearer's legs to a position above the buttocks and adjacent the spine where the triangular end portion 22 is secured by an adhesive as discussed below. It is understood that the end section may be any shape (circular, rectangular, ovoid, trapezoidal, etc as long as there is provided sufficient area to apply a releasable adhesive to securely attach the strapless g-string to the skin of the wearer. In this g-string embodiment, the strip 20 of the garment extends through the wearers' legs and up the back in the crease between the buttocks.

FIG. 6 is a pictorial view of the wearer from the rear. As seen in FIG. 6, the lower strip 48 extends between the wearer's legs to a position above the buttocks and adjacent the spine where the wide end of the trapezoidal section 52 is secured by adhesive as discussed below. It is understood that the end section 50 may be any shape (circular, triangular, rectangular, ovoid, etc.) as long as there is provided sufficient area to apply a releasable adhesive to securely attach the strapless thong to the skin of the wearer. In this thong embodiment, the strip 48 of the garment covers the cleft in the buttocks.

The material used to make the thong or g-string undergarment may be any material, paper or cloth. The material is preferably stretchy, having either 2-way or 4-way stretch.

The adhesive is preferably a pressure sensitive adhesive (PSA). The PSA layer may be a permanently grown PSA as disclosed in U.S. Pat. Nos. 6,758,720 & 6,780,081, both of which are incorporated by reference, or may be in the form of a non-permanent adhesive such as a double-sided tape. The adhesive layer may include any type of PSA that is suitable for removably attaching a cloth or paper material to a user's skin, such as various types and forms of double-sided tape and permanently grown PSAs. PSAs suitable for use in embodiments of the invention include but are not limited to silicone PSAs (such as Dow Corning MD7-4502 & MD7-4602), water and solvent-based acrylic PSAs and combinations thereof. The PSA layer allows the user to place the undergarment at the most comfortable position. The amount and type of PSA comprising the PSA layer can vary as can the portions of the interior surface that have the pressure sensitive adhesive layer applied thereto.

In some embodiments, the pressure sensitive adhesive layer is a re-usable PSA that is permanently grown to an interior surface of the undergarment such as 16 and 24 shown in FIG. 1. The interior surface may include a thermoplastic layer to which the adhesive is grown. The pressure sensitive adhesive layer can also be applied to the interior surface of the underwear by other methods such as spray coating, hot melting, extrusion application, die application, or other methods known for applying a PSA to a substrate. In some embodiments, the PSA is a double-sided tape. The pressure sensitive adhesive layer will not readily shift once it is positioned on the user and can be re-used repeatedly without losing its adhesive properties. Preferably, the pressure sensitive adhesive layer has an adhesion force to the undergarment which is greater than a cohesion force to the user's skin. More preferably, the pressure sensitive adhesive layer is further able to withstand tremendous movement and pressure from the user without slipping and can even be subjected to water or sweat without degeneration of the adhesive properties. In preferred embodiments, if the pressure sensitive adhesive layer becomes dirty (e.g. with dust, lint or debris), it can be cleaned with soap and water to fully restore the adhesive properties. The pressure sensitive adhesive layer itself is the only required means for adjoining the underwear to the user. In preferred embodiments, the pressure sensitive adhesive is permanently grown to a thermoplastic film that comprises a portion of the interior surface of thong or g-string.

In some preferred embodiments, double-sided tape is applied to attach the undergarment to the body. Suitable tapes include hairpiece tapes and fashion tapes. Hairpiece and fashion tapes include Whiteliner, Redliner, Brownliner (German-Brown cloth tape), Blue liner and Bonding strips. Redliner tape will hold for several days. Brownliner tape is similar to Redliner but is thicker and preferred for people who perspire heavily. Bonding strips may be used for extended wear or wear during more vigorous exercise. In preferred embodiments, Whiteliner tapes are used such as SEXY LITTLE THINGS available from Victoria's Secret (RN #114709). In a most preferred embodiment, the double sided tape is a whiteliner tape such as 3M #1522, which is surgical quality, medical grade, latex free and hypoallergenic. This tape may be used through several washings of the garment before replacement, and is comfortable to wear, even for persons with sensitive skin. The double-sided tape has the advantage that it can be replaced as needed and may be positioned to where it is the most comfortable and/or least intrusive for the wearer. In some embodiments, a liquid adhesive, such as Anchor! (You're Looking Good, Ontario, Canada) may be used.

It is understood that the interior surface can be formed from a number of other materials besides a thermoplastic film material. The interior surface serves as a pressure sensitive adhesive support layer. The interior surface can be formed from any type of film material or fabric material suitable for adjoining to a PSA. One preferred fabric material is an unwoven fabric, which can be substantially impervious to the PSA. Additionally, various types of woven fabrics can be made suitable for the function of supporting the PSA layer. Thus, a variety of materials and methods can be used to form the interior attachment surface of the undergarment and for applying the PSA layer to the interior surface.

While FIGS. 1-6 exemplify a strapless g-string (FIGS. 1, 2, and 5) and a strapless thong (FIGS. 3, 4, and 6), it will be appreciated that the concept is readily adaptable to many styles, from full rear coverage to a string rear. The invention is by no means limited to the examples shown in the figures.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. An open-sided brief garment, comprising:

an anterior portion comprising cloth or paper material configured to cover the genital region of a wearer and having an interior surface along a top region; and a posterior portion comprising cloth or paper material attached to the anterior portion by a material strip or string and having an interior surface along a distal region;

wherein the anterior portion and the posterior portion attach to the wearer by removable silicone affixed to interior surfaces of the anterior and the posterior portions of the garment, whereby the garment does not readily shift after positioning the removable silicone portions on the wearer, wherein the silicone has an adhesion force to the interior surface of the posterior and anterior portions which is greater than a cohesion force to the wearer's skin and wherein the top region of the interior surface of the anterior portion and the distal region of the interior surface of the posterior portion consists of silicone directly on the interior surface of the cloth or paper material.

2. The open-sided brief garment of claim 1, wherein the anterior portion is generally triangular.

3. The open-sided brief garment of claim 1, which is a thong style.

4. The open-sided brief garment of claim 1, which is a G-string style.

5. The open-sided brief garment of claim 1 which is reusable.

6. The open-sided brief garment of claim 1, wherein the pressure sensitive adhesive is surgical quality, medical grade, latex free and hypoallergenic.

7. The open-sided brief garment of claim 1, which further comprises a cotton liner.

8. The open-sided brief garment of claim 1 which is one piece.

9. The open-sided brief garment of claim 1 comprising a binding material attached to the garment by stitching.

* * * * *